United States Patent [19]

Takebe

[11] Patent Number: 4,457,631

[45] Date of Patent: Jul. 3, 1984

[54] ATTENUATION-MODULATION CIRCUIT FOR GENERATING ELECTRONIC BELL SOUNDS FOR A TIMEPIECE

[75] Inventor: Katsuhiko Takebe, Tokyo, Japan

[73] Assignee: Rhythm Watch Co., Ltd., Tokyo, Japan

[21] Appl. No.: 437,265

[22] Filed: Oct. 28, 1982

[30] Foreign Application Priority Data

Oct. 29, 1981 [JP] Japan ..... 56-173407

[51] Int. Cl.[3] ..... G04B 21/00

[52] U.S. Cl. ..... 368/273; 84/1.24; 368/72

[58] Field of Search ..... 84/1.24, 1.26; 368/273, 368/272, 72, 73, 75

[56] References Cited

U.S. PATENT DOCUMENTS

| | | | |
|---|---|---|---|
| 4,046,047 | 9/1977 | Roberts | 84/1.24 |
| 4,056,033 | 11/1977 | Inoue et al. | 84/1.24 |
| 4,173,915 | 11/1979 | Gross | 84/1.26 |
| 4,175,465 | 11/1979 | Schmoll | 84/1.26 |
| 4,273,019 | 6/1981 | Goto | 84/1.24 |

*Primary Examiner*—Bernard Roskoski
*Attorney, Agent, or Firm*—Koda and Androlia

[57] ABSTRACT

An electronic bell sound generating circuit for a timepiece for generating a sound simulating a bell sound produced by a motor driven bell-striking system. The circuit includes an audio frequency signal generating circuit, an optional number of attenuation-modulation circuits, an alarm trigger circuit, an attenuation control circuit and a sound generating circuit. The audio frequency generating circuit includes a reference signal generator and a frequency dividing circuit. The attenuation-modulation circuit includes MOS transistors connected in parallel and gate circuits connected to gates of the MOS transistors. The attenuation control circuit includes shift registers comprising flip-flops connected in series. The circuit works to stepwisely increase the combined on-operation resistance of the MOS transistors to thereby decrease the value of the current of audio frequency signals to the sound generating circuit in order to obtain an attenuated sound. When two or more attenuation-modulation circuits are provided, different audio frequencies are supplied to each respectively and the output signals from the respective attenuation-modulation circuits are superposed in the sound generating circuit. The time cycle for stepwise decrease of the current value of the audio frequency signals is set at 0.0625 seconds.

5 Claims, 4 Drawing Figures

ATTENUATION-MODULATION CIRCUIT FOR GENERATING ELECTRONIC BELL SOUNDS FOR A TIMEPIECE

BACKGROUND OF THE INVENTION

1. Field of the Invention

The present invention relates to an electronic bell sound generating circuit for a timepiece and more particularly to a circuit network having a simpler structure than conventional systems and which is capable of generating an electronically simulated sound bearing a close resemblance to a bar bell sound or bell sound generated by a motor driven bell-striking mechanism.

2. Prior Art

Electronic sounds which have been used conventionally as time signals for timepieces are inferior in sound quality to natural bell sounds or bar bell sounds and they frequently cause some unpleasantness to the senses of the listeners. Therefore, in an effort to bring these electronic sounds closer to natural bell sounds and bar bell sounds, attempts have been made to mix a plurality of various frequencies or to use systems designed to graudally attenuate the volume of sound.

As a method for attenuating the sound volume, conventionally the charge and discharge of condensers and resistors provided outside of the timepiece circuits have been used. However, in recent years, in order to obtain a more accurate and complicated attenuated sound, resistance control circuits for stepwisely decaying the quality of current to the sound generating circuit that functions to provide the bell sounds have been employed.

The resistance control circuit system described above has been constructed by connecting a plurality of circuits in parallel. These respective circuits are provided with resistances and transistors serving as electronic switches which are connected in series. Accordingly, the system operates in the following manner. After the hour tone of the timepiece has been generated, at each specified time interval, the transistors are turned on or off in sequence. In this way, combined resistance value of the resistors connected in series to the transistors is gradually increased. This in turn causes a graduate decrease in value of current to the sound generating circuit. As a result, an alarm tone with a gradually decreasing sound volume is produced.

This above described system enables an attenuating sound with an optional pattern to be produced by controlling and varying the speed for the sequential turning on or turning off of the transistors as well as setting the resistance value of the resisters. As a result, the sound thus formed can be further approximated to the natural bell sound or bar bell sound.

However, this system has certain disadvantages. That is, in this system, when the timepiece circuit is made into an integrated circuit, although transistors used as the electronic switch can be built into the integrated circuit, the plurality of resistors connected in series to the transistors must be provided outside of the integrated circuit. Consequently, the number of IC pins, the manufacturing process and part required for making up the system increases. As a further result, the cost for producing this system is also increased.

SUMMARY OF THE INVENTION

It is therefore, a general object of the present invention to overcome the above-described problems found in the prior art with regard to electronic bell sound generating systems for timepieces.

Another object of the present invention is to provide an electronic bell sound generating circuit for timepieces which is capable of generating electronicly simulated sound further approximated to the natural bell sounds created by bell-striking systems.

It is still another object of the present invention to provide an electronic bell sound generating circuit for timepieces that does not require an increased number of IC pins, manufacturing processes, parts, etc. for manufacturing.

It is yet another object of the present invention to provide an electronic bell sound generating circuit for timepieces that consumes less electrical power than conventional systems to thereby contribute to an increase in battery life.

The above described objects of the present invention are achieved by providing a new and improved electronic bell sound generating circuit for timepieces with a construction and function as described below.

The electronic bell sound generating circuit includes an audio frequency signal generating circuit, an attenuation-modulation circuit, an alarm trigger circuit, an attenuation control circuit and a sound generating circuit. In this electronic sound generating circuit, the audio frequency signal generating circuit serves to supply audio frequency signals, the attenuation-modulation circuit is provided with a plurality of MOS transistors connected in parallel and a plurality of gate circuits and the outputs of the gate circuits are connected to the gates of the respective MOSFETs while the inputs of the gate circuits receive the audio frequency signals from the audio frequency signal generating circuit, the alarm trigger circuit provides alarm trigger signals at a preset time and the alarm trigger signals actuate the gate circuits so that the audio frequency signals are supplied to the MOS transistors, the attenuation control circuit is actuated by the alarm trigger signal and generates attenuation control signals with a preset time cycle to turn off the gate circuits after some predetermined time interval to cause the MOS transistors connected to the outputs of the gate circuits to turn off in sequence and the sound generating circuit is connected in the form of an open drain connection to the MOS transistors of the attenuation-modulation circuit and generates sounds in response to the output signals of the attenuation-modulation circuit.

The functions of the new and improved electronic bell sound generating circuit for timepiece are described below. The combined on-operation resistance of the MOS transistors connected in parallel is increased stepwisely according to a specified time cycle. This operation effects a stepwise decrease in value of current inputted to the sound generator so that attenuated sounds can be produced.

Another means to achieve the objects of the present invention is by way of a second construction of the electronic bell sound generating circuit with the following characteristics.

The second construction includes an audio frequency signal generating circuit, not less than two attenuation-modulation circuits, an alarm trigger circuit, an attenuation control circuit and a sound generating circuit. In this second construction, each of the elements functions as follows. At least two attenuation-modulation circuits are each provided with a plurality of MOS transistors connected in parallel and a plurality of gate circuits. The gate circuits are connected to the gate inputs of the respective MOS transistors and the gate circuits of the respective attenuation-modulation circuits receive audio frequencies from the audio frequency signal generating circuit which are different respectively in frequency for each of the respective attenuation-modulation circuits. The alarm trigger circuit supplies an alarm trigger signal at a preset time. The alarm trigger signal causes all of the gate circuits of the attenuation-modulation circuit to open to supply the audio frequency signals respectively to the gate of the MOS transistors. The attenuation control circuit is started by the alarm trigger signal and supplies attenuation-modulation signals with a specified time cycle. The attenuation control signals function to cause the gate circuits of each attenuation-modulation circuit to close one by one at the preset time interval of each gate circuit. This closure is arranged to occur synchronously in each gate circuit corresponding to the respective attenuation-modulation circuits. By this operation, the MOS transistors connected to the outputs of these gate circuits are turned off in sequence in parallel with the closure of the corresponding gate circuits. The sound generating circuit is connected to the MOS transistors of the attenuation-modulation circuits. The connection is in the form of an open drain connection. The sound generating circuit functions to superpose the output signals from the respective attenuation-modulation circuits and to generate modulated sounds.

With the above described construction, the synthetic on-operation resistances of the MOS transistors connected in parallel is stepwisely increased with the predetermined cycle. This operation in turn effects the stepwise decrease in current value of the audio frequency signals with various audio frequencies which are inputted in superpositon to the sound generator to obtain the simulated bell sound.

BRIEF DESCRIPTION OF THE DRAWINGS

The objects and attendant advantages of the present invention will be readily appreciated as the same becomes better understood by reference to the following detailed description taken in connection with the accompanying drawings wherein like reference numerals denote like elements and in which.

DETAILED DESCRIPTION OF THE INVENTION

Figure 1:
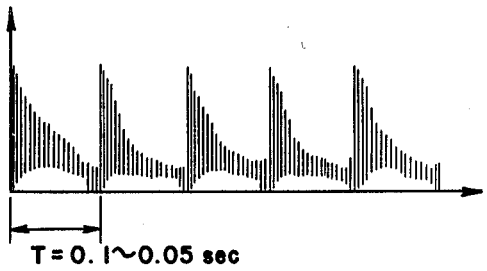
FIG. 1 is a waveform chart for the commonly used bell-striking mechanism.

Referring to FIG. 1, shown therein is the oscillatory wave pattern of a bell sound produced by a conventional bell-striking mechanism. The sound produced by a conventional bell-striking mechanism has certain characteristic points. The mechanical bell-striking vibration is carried out at a frequency of about 10 to 20 Hz. As a result, the mechanical bell-striking oscillation time cycle T becomes approximately 0.1 to 0.05 seconds. Within the oscillation time cycle T, a vibration composed of a combined, plurality of frequencies which are determined depending on the shape and size of the bell is carried out. This vibration is characterized by a damping tendency within the time cycle T.

Accordingly, in the preferred embodiment of the present invention, in order to obtain the oscillatory characteristics as shown in FIG. 1, an electronic bell sound generating circuit is constructed as described below.

Figure 2:
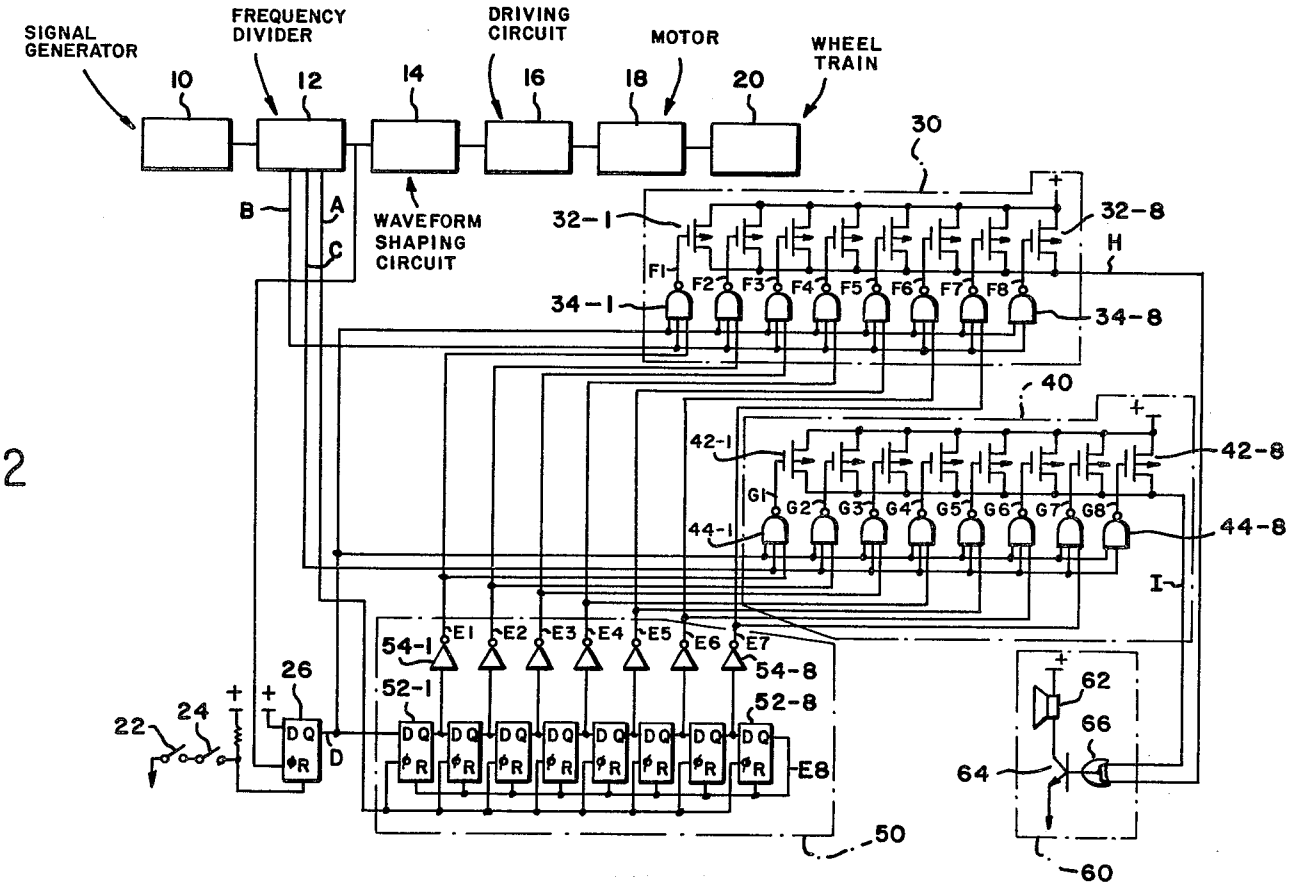
FIG. 2 is a circuit diagram showing a preferred embodiment of a sound generating circuit according to the present invention.

Referring to FIG. 2, shown therein is an appropriate embodiment of an electronic sound generating circuit in accordance with the present invention. In this embodiment, the circuit is provided in an electronic alarm clock. The electronic alarm clock includes a reference signal generator 10, such as quartz oscillator, a frequency dividing circuit 12 for dividing reference signal into pulses with the desired frequency, a waveform shaping circuit 14 for shaping the driving pulses of 1 to 2 HZ, a drive circuit 16 having an amplifier and a synchronous motor 18 for the timepiece. The driving force of the motor 18 is transmitted to a wheel train 20 to which the time indicator hands are fixed.

In addition, the clock system is provided with an alarm on-off switch 22 for actuating the alarm mechanism and an alarm switch 24. The alarm on-off switch 22 is controlled manually by its user for turning on and off the alarming mechanism in order to activate or deactivate. The alarm switch 24 causes the alarming operation by being turned on at a desired time preset for giving the alarm through a linkage with the wheel train 20 of the clock. In other words, when both switches 22 and 24 are turned on at a preset time for alarming, a flip-flop (FF) 26 for shaping the waveform is released from the reset state. Then, by synchronizing with a synchronous signal from the frequency dividing circuit 12, an alarm triggers signal D is generated from the Q terminal of FF 26.

The characteristic features of the present invention are the following two points. That is, first, in order to obtain the simulated bell sound, two types of signals with audio frequencies which are different from each other are periodically attenuatted and modulated. Second, these attenuated and modulated output signals are superposed so that the bell sound as shown in FIG. 1 can be obtained.

For achieving the purposes described above, electronic sound bell generating circuit includes four types of circuits. That is, a first attenuating-modulation circuit 30, a second attenuation-modulation circuit 40, an attenuation control circuit 50 for supplying an attenuation control signal with a predetermined time cycle to both attenuation-modulation circuits 30 and 40 and a sound generating circuit 60 that functions to generate sounds by superposing the output signals of both attenuation-modulation circuits 30 and 40.

The first attenuation-modulation circuit 30 includes resistance control circuits. In particular, includes eight MOS transistors 32 which are connected in parallel. The MOS transistors 32 in this embodiment are formed by a p-channel open drain connection and depending on the combination of their on-operation resistances, the value of the current of the output signal H varies.

To the gate of each of the MOS transistors is connected a NAND gate 34. To the input of each of the NAND gates 34, the alarm trigger signal D from the FF 26, the first audio frequency signal B that is to be modulated and is generated by the frequency dividing circuit 12 and the attenuation control signal E from the attenuation control circuit 50 are supplied respectively. In this embodiment, the first audio frequency signal is set at 4 KHz in frequency.

The attenuation control circuit 50 for supplying the attenuation control signal E is in the form of a step signal generator including H stages of flip-flops 52 connected in series. To the input of the attenuation control circuit 50 is supplied the alarm trigger signal D which is in turn supplied to the first step flip-flop 52-1. Then, the inputs of the remaining stages, i.e., the second and the following stages, the Q output of each preceding stage is supplied. The Q output of the last stage, flip-flop 52-8 is supplied to the reset inputs of all of the flip-flops 52. Furthermore, to the clock input of each of the flip-flop 52, is supplied the pulse signal A of the frequency dividing signal 12. Depending on the time cycle of the pulse signal A, the time cycle of the attenuation control signal is determined. In this embodiment, the pulse signal A is set at 128 Hz. As a result, one cycle of the attenuation signal E is set to be 16 Hz.

The attenuation control circuit 50 also includes inverters 54. The Q output of each of the flip-flop 52 is inverted by each of the inverters 54 and then supplied as the control signal E to the input of the NAND gates 34 of the attenuation-modulation circuit 30.

The second attenuation-modulation circuit 40 has a structure similar to that of the first attenuation-modulation circuit 30. That is, it consists of eight MOS transistors 42 and NAND gates 44. To the input of each of the NAND gates 44, the above described alarm trigger signal D, the second audio frequency signal C from the frequency dividing circuit 12 and the attenuation control signal E are supplied. In this embodiment, the second audio frequency signal C is set at 2 KHz in frequency.

The output signals H and I of the attenuation-modulation circuits 30 and 40 are supplied to the sound generating circuit 60. The sound generating circuit 60 is provided with a speaker 62, a drive transistor 64 and a wired OR gate 66. In the sound generating circuit 60, the output signals of the attenuation-modulation circuits 30 and 40 are superposed and supplied to the gate of the transistor 64. Then, by the speaker 62, both audio frequency signals B and C are adjusted by drive control by means of the superposition of the attenuated and modulated signals.

The preferred embodiment of the present invention is constructed as described above and in the following paragraphs the operation of the preferred embodiment with reference to the waveform chart in FIG. 3.

Firstly, the operation of the first attenuation-modulation circuit will be described. Upon actuation of an alarm by the alarm trigger signal, the attenuation-modulation circuit 30 regulates the first audio frequency signal B by resistance-control utilizing each of the MOS transistors 32. During this operation, the regulation timing is controlled by the attenuation control signal E. In other words, at the initial stage, the output of the alarm trigger signal D, all of the attenuation control signals E open the NAND gates 34. As a result, the combined resistance of the attenuaton-modulation circuit 30 becomes its lowest. Consequently, the output H of the attenuation-modulation circuit becomes a high value. Then, from this initial stage, at every input of the pulse signal A, the attenuation control circuit 50 breaks its outputs E in sequence. Corresponding to this operation, each of the MOS transistors of the attenuation-modulation circuit 30 turns off in response to the signal F of each corresponding NAND gate 34. This in turn effects the gradual increase of the combined resistance of the attenuation-modulation circuit 30. Proportional to this gradual increase in combined resistance, the value of the current of the output signal H is lowered step by step.

The second attenuation-modulation circuit 40 operates in the same manner as the first attenuation-modulation circuit 30. Accordingly, the second audio frequency signal is modulated by means of the attenuation control signal E and with the output G of the NAND gates 44 and the combined resistances of the MOS transistors 42 varies in sequence. Then, by combining the above, the output signal I is obtained for the second attenuation-modulation circuit 40.

Figure 3:
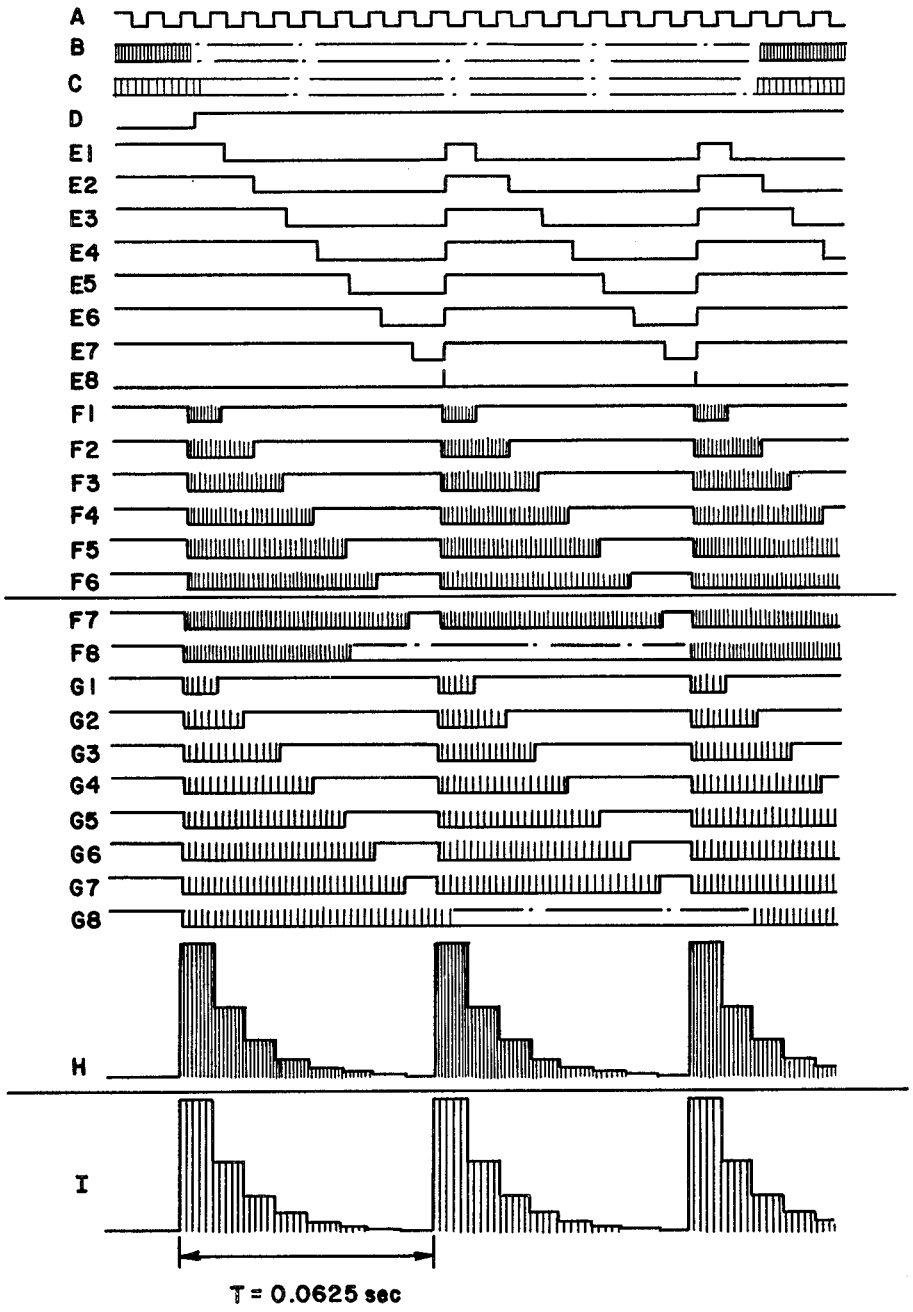
FIG. 3 is a waveform chart of the circuit of FIG. 2.

As should be clearly understood from FIG. 3, the output signals H and I of both attenuation-modulation circuits 30 and 40 show a characteristic form of sequential stepwise attenuation with plural stage patterns that occur during a time cycle T=0.0625 seconds. Then, these output signals H and I are superposed and supplied to the sound generating circuit 60. As a result, it is possible to generate a simulated bell sound with very close resemblance to the bell sound produced by conventional bell-striking mechanism as shown in FIG. 1 from the speaker 62.

As has been described above, the embodiment shown here uses the on-resistance of the MOSFET that is used as the electronic switch instead of connecting resistances in series to the transistors which serve as the electronic switch. Therefore, it is unnecessary to provide the resistances outside of the circuit and all of them can be provided inside of the integrated circuit. This in turn makes it possible to reduce the number of IC pins, parts installed outside as well as manufacturing processes compared with those require for conventional systems.

Also, in this embodiment, firstly, all of the MOSFETs connected in parallel are turned on. Then, the MOSFETs are turned off one after another in order to stepwisely decrease the current inputted to the sound generating circuit and to form the attenuated sound. Therefore, compared with a system wherein the MOSFETs with various on-resistances are turned on one by one in sequence, the chip area for the MOSFET group in the system of the present invention formed into the integrated circuit is cut down to less than half.

Furthermore, in this embodiment, for obtaining the simulated bell sound, two types of signals having different frequencies, i.e., 2 KHz and 4 KHz respectively which are at a frequency ratio of 1:2 are inputted. This arrangement makes it possible to take out the signals directly from the frequency dividing stages and this in turn eliminates the need for additional designing of the circuit for this specific circuit construction. In addition, the reset input of the 8-stage flip-flops 55 which make up the attenuation control circuit 50 is provided by the Q output of the last stage flip-flop 52-8. As a result, for the alarm trigger signal D, the H signal can be used. Here again, a circuit construction for generating the specific alarm trigger signal D is unnecessary.

Figure 4:
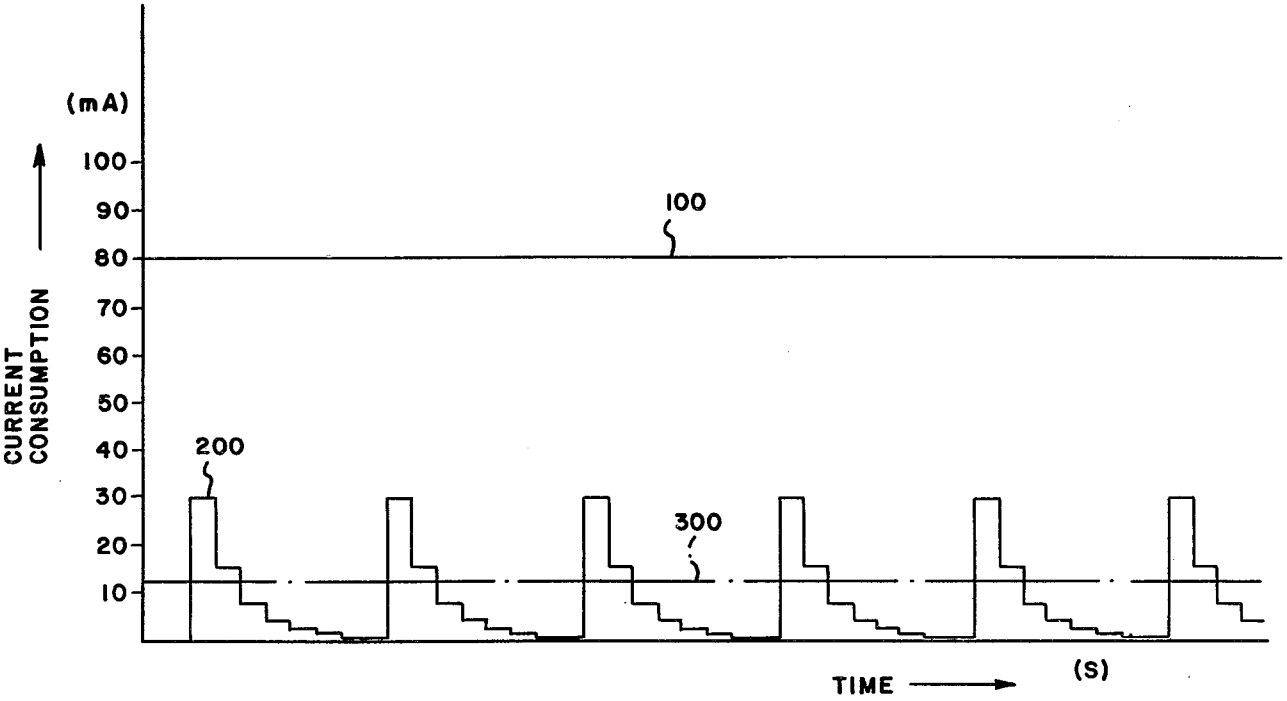
FIG. 4 is an illustrative chart showing the comparison of power consumption between the present invention and a conventional circuit.

FIG. 4 shows a graph in comparing the power consumption between a conventional bell-striking mechanism driven by DC motor and an electronic bell sound generating circuit according to the present invention. From the graph, the current 100 consumed by the conventional bell-striking system driven by a DC motor is 80 mA average while the current 200 consumed by the electronic bell sound generating circuit according to the present invention is 30 mA even at the peak time, with an average value 300 of 12 mA. As is apparent from FIG. 4, the present invention is able to provide a substantial savings in power consumption over the conventional bell-striking system driven by a DC motor with a resultant prolonged battery life.

In this embodiment described above, two attenuation-modulation circuits are provided. However, the number of such circuit is not limited in this invention and any number of this type of circuit can be provided. Furthermore, while the described embodiment represents the preferred form of the electronic bell sound generating circuit provided with two attenuation-modulation circuits, it is obvious to those skilled in the art that three or more attenuation-modulation circuits may be provided without departing from this invention in its broader aspects.

The advantages of the present invention should be apparent from the above description. That is, because the on-resistance of the MOSFETs connected in parallel is used, resistances provided outside of the circuit system are not required and everything can be incorporated into the integrated circuit. Therefore, the number of IC pins, the parts to be provided outside the system and the manufacturing processes can be smaller than that of the conventional systems. In addition, for the integrated circuit including MOSFETs all built into it, the present invention uses the mechanism to first turn on all of the MOSFETs connected in parallel and then to turn off those MOSFETs one after another in order to stepwisely decrease the current inputted to the sound generating circuit for obtaining the attenuated sound. Consequently, compared to the conventional sytems wherein MOSFETs with various on-resistance are turned on one by one in sequential order, the chip area of the MOSFET group utilizing the present invention can be reduced by more than half.

It should be apparent to those skilled in the art that the above described embodiment is but one of the many possible embodiments incorporating the principles of the present invention. Numerous and varied other arrangements can be devised by those skilled in the art without departing from the spirit and scope of the present invention.

I claim:

1. An electronic bell sound generating circuit for a timepiece comprising:

an audio frequency signal generating circuit for generating a plurality of audio frequency signals;

at least two attenuation-modulation circuits comprising a plurality of MOS transistors connected in parallel and a plurality of gate circuits each connected to a gate of each of the MOS transistors with respectively different audio frequencies each supplied to the gate circuits of each of the respective attenuation-modulation circuits;

an alarm trigger circuit for providing an alarm trigger signal at a preset time in order to effect the open state for all of the gate circuits and to supply the audio frequency signals to the gates of the MOS transistors, respectively;

an attenuation control circuit that is actuated by the alarm trigger signal and provides attenuation control signals with a predetermined time cycle in order to close one by one the gate circuits of each of the respective attenuation-modulation circuits at every specified time interval, thereby causing the MOS transistors connected to the outputs of those gate circuits to turn off; and a sound generating circuit that is connected in a form of an open drain connection to the MOS transistors provided in the attenuation-modulation circuits to generate sounds by superposing the output signals from the respective at least two attenuation-modulation circuits;

whereby the combined on-operation resistance of the MOS transistors connected in parallel are increased stepwisely with the specified time cycle to effect a stepwise decrease in the value of current of the plurality of audio signals with different audio frequencies inputted in superposition to the sound generator to obtain the simulated bell sound.

2. An electronic bell sound, generating circuit for a timepiece as set forth in claim 1, wherein the audio frequency signal generating circuit comprises a reference signal generator for generating the reference signal of timepiece and a frequency dividing circuit that divides the reference signal to the desired frequency and that provides a plurality of audio frequencies which are taken out from the middle of the frequency dividing stages thereof.

3. An electronic bell sound generating circuit for a timepiece as set forth in claims 1 or 2, wherein the attenuation-modulation circuit is formed of shift registers provided with flip-flops connected in series and to an input of of the first stage flip-flop, the alarm trigger signal is inputted while the output of the last stage flip-flop is inputted to the reset inputs of all of the flip-flops.

4. An electronic bell sound generating circuit for a timepiece as set forth in claims 1 or 2, characterized in that the specified time interval for stepwise decrease of current of the audio frequency signals is set to be 0.0625 seconds.

5. An electronic bell sound generating circuit for a timepiece as set forth in claim 3, characterized in that the specified time interval for stepwise decrease in current value of the audio frequency signals is set at 0.0625 seconds.

* * * * *